United States Patent [19]

Oishi et al.

[11] 4,191,067

[45] Mar. 4, 1980

[54] RATCHET FEED MECHANISM

[75] Inventors: Masaaki Oishi; Itaru Ashida; Tetsuro Suzuki, all of Tokyo, Japan

[73] Assignee: Kabushiki Kaisha Seikosha, Japan

[21] Appl. No.: 821,503

[22] Filed: Aug. 3, 1977

[30] Foreign Application Priority Data

Aug. 3, 1976 [JP] Japan ..... 51-92488

[51] Int. Cl.[2] ..... G05G 1/00

[52] U.S. Cl. ..... 74/577 M

[58] Field of Search ..... 74/47, 116, 122, 575, 74/577 R, 577 M; 58/85.5

[56] References Cited

U.S. PATENT DOCUMENTS

| | | | |
|---|---|---|---|
| 71,593 | 10/1902 | Medley | 74/577 M |
| 541,380 | 7/1895 | Diehl | 74/116 |
| 1,979,028 | 10/1934 | Ewart | 74/577 M |
| 3,504,559 | 4/1970 | Shaw, Jr. et al. | 74/575 |

FOREIGN PATENT DOCUMENTS

| | | | |
|---|---|---|---|
| 387733 | 1/1924 | Fed. Rep. of Germany | 74/116 |

*Primary Examiner*—Samuel Scott
*Assistant Examiner*—Wesley S. Ratliff, Jr.
*Attorney, Agent, or Firm*—Robert E. Burns; Emmanuel J. Lobato; Bruce L. Adams

[57] ABSTRACT

The place shift-up mechanism of a digital clock comprises ratchet feed mechanism which permits manual setting of the clock even during the shift-up operation. The ratchet feed mechanism comprises an eccentric cam secured to a rotary shaft which also carries an eccentric operation pin. A ratchet wheel is rotatably supported by the shaft. A place shift-up lever is supported so as to be capable of rocking and sliding movement and has a forked leg plate with spaced legs receiving the eccentric cam between them. One leg of the forked leg plate has a feed pawl for engagement with the ratchet wheel and also a hook pawl engageable by the operation pin to move the place shift-up lever in one direction. The other leg of the forked leg plate has a return pawl which is engageable by the operation pin to move the plate shift-up lever in an opposite direction. The place shift-up lever is rocked by the eccentric cam and is moved by the operation pin first in one direction and then in the other to cause the feed pawl to engage the ratchet wheel to advance it one tooth for each revolution of the rotary shaft.

7 Claims, 10 Drawing Figures

RATCHET FEED MECHANISM

FIELD OF INVENTION

The present invention relates to a ratchet feed mechanism and particularly to ratchet feed mechanism for the place shift-up mechanism of a digital clock and the like.

BACKGROUND OF THE INVENTION

In the place shift-up mechanism of conventional digital clocks and the like it is impossible to correct the time during the shift-up operation from the second drum to the minute drum for advancing the minute drum one figure. If a time correction is forceably made, gears and other parts of the mechanism tend to be damaged.

SUMMARY OF THE INVENTION

It is an object of the present invention to eliminate the above mentioned problem and provide a ratchet feed mechanism which is easy to assemble, reliable in its operation and in addition makes it possible to correct the time in a normal direction even during the shift-up operation.

In accordance with the invention, the ratchet feed mechanism, for example for a digital clock, comprises an eccentric cam secured to a rotary shaft which also carries an operation pin fixed eccentrically to the shaft so as to orbit about the axis of the shaft. A ratchet wheel is rotatably supported by the shaft. A place shift-up lever is supported so as to be capable of rocking and sliding and has a forked leg plate with spaced legs receiving the eccentric cam between them. One leg of the forked leg plate carries a feed pawl for engagement with the ratchet wheel and also a hook pawl engageable by the operation pin to move the place shift-up lever in one direction. The other leg of the forked leg plate of the place shift-up lever has a return pawl which is engageable by the operation pin to move the place shift-up lever in an opposite direction. As the place shift-up lever is rocked and moved to and fro by the eccentric cam and the operation pin, the feed pawl on the place shift-up lever engages the ratchet wheel to advance it one tooth for each rotation of the rotary shaft.

With this construction it is possible to move the ratchet wheel manually in a forward direction, for example to set the clock, even during the shift-up operation without in any way damaging the mechanism.

BRIEF DESCRIPTION OF DRAWINGS

The nature, objects and advantages of the invention will be more fully understood from the following description of a preferred embodiment of the invention shown by way of example in the accompanying drawings in which.

DESCRIPTION OF PREFERRED EMBODIMENTS

Figure 1:
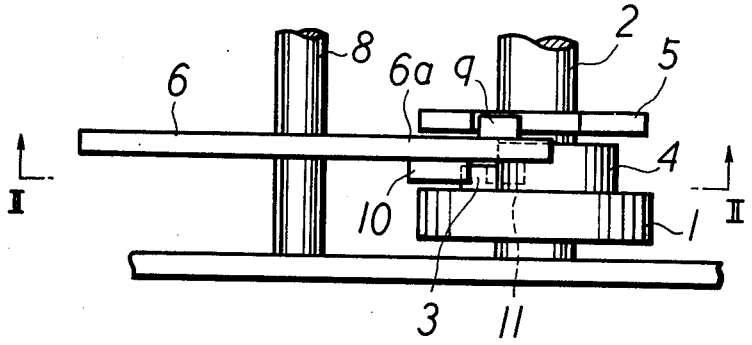
FIG. 1 is a plan view showing an embodiment of the invention adapted to the shift-up operation for shifting up from a second digit to a minute digit in a digital clock.

The embodiment of the invention shown by way of example in FIGS. 1 to 4 of the drawings comprises a second drum 1 which is secured to a rotary shaft 2 which rotates once per minute. An operation pin 3 projects laterally from one side of the second drum 1 and is eccentric of the shaft 2 so as to orbit about the axis of the shaft as the shaft rotates. An eccentric cam 4 is secured to the shaft 2 while a ratchet wheel 5 is rotatably supported by the shaft.

A shift-up lever 6 has a forked leg plate with spaced legs 6*a* and 6*b* adapted to receive the eccentric cam 4 between them. The shift-up lever 6 is rockably and slidably supported by a stationary shaft 8 which is inserted into an elongated pole 7 that is formed in the base section 6*c* of the place shift-up lever 6.

One leg 6*a* of the forked leg plate has a feed pawl 9 projecting from one surface to engage with the ratchet wheel 5 and a hook pawl 10 projecting from the opposite surface to engage with the operation pin 3. The other leg 6*b* has a return pawl 11 projecting from one face to engage with the operation pin 3.

The elongated hole 7 in the base section 6*c* of the place shift-up lever 6 is formed as a continuation of the space between the legs 6*a* and 6*b* and is separated from this space by a restricted portion 7*b* which has a width slightly less than the diameter of the stationary shaft 8. In order to assemble the ratchet feed mechanism all that need be done is to push the place shift-up lever 6 onto the stationary shaft 8 from the left. While the stationary shaft 8 is positioned between the legs 6*a* and 6*b* of the forked leg plate, the place shift-up lever 6 is pushed toward the right until the tips of the legs 6*a*, 6*b* are brought into contact with the eccentric cam 4. The forked leg plate is sufficiently resilient to permit the legs 6*a*,6*b* to spring apart sufficiently for the stationary shaft 8 to pass through the restricted portion 7*b* into the elongated hole 7.

Figure 2A:
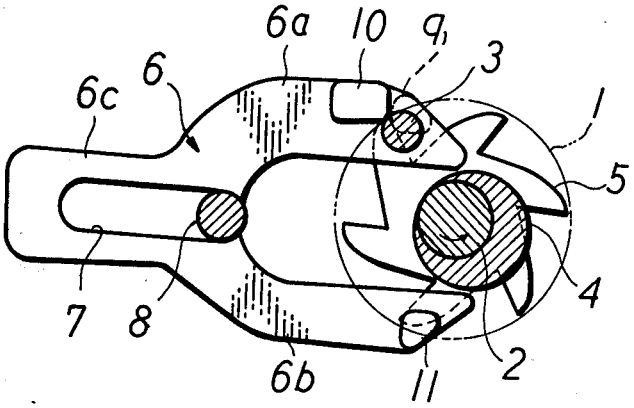
FIGS. 2*a* through 2*f* are sectional views taken along the line II—II of FIG. 1 and showing schematically the mode of operation stepwise with the passage of time.

The mode of operation of the ratchet feed mechanism shown by way of example is as follows. FIG. 2*a* schematically illustrates the operating position when the ratchet 5 has been shifted up by one tooth. With the state shown in FIG. 2*a* as the starting position, the place shift-up operation for subsequent teeth will be explained with reference to FIGS. 2*a* through 2*f* which illustrate the position of the parts at ten second intervals.

Figure 2B:
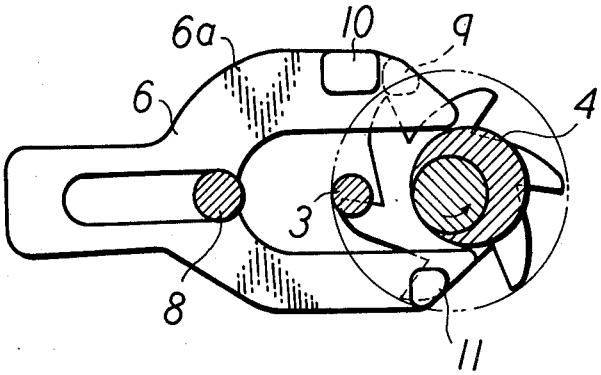
Figure 2C:
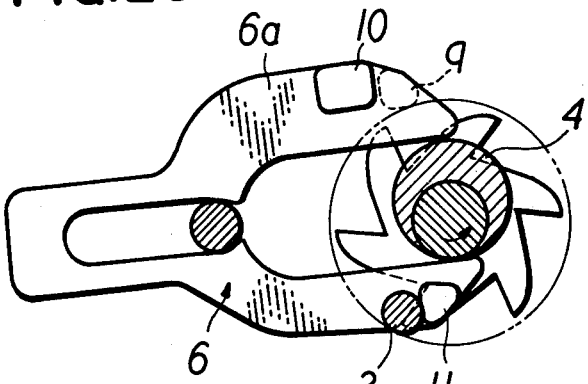
Figure 2D:
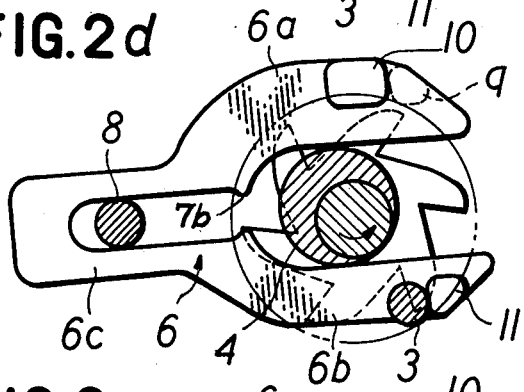
Figure 2E:
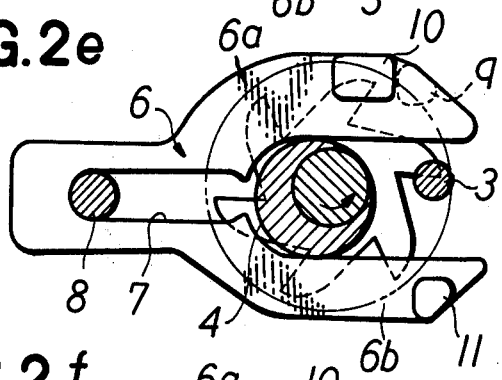
Figure 2F:
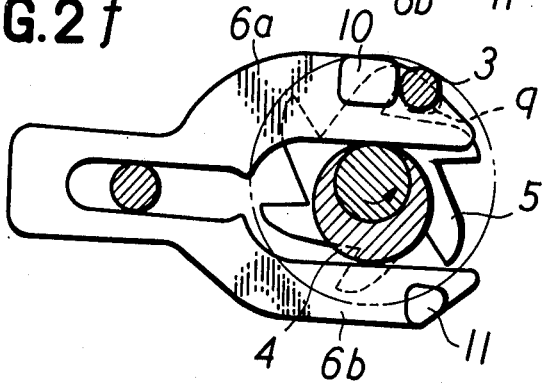

From the start position shown in FIG. 2*a*, the operation pin 3 rotates counterclockwise along with rotation of the shaft 2 and second drum 1 and passes by the hook pawl 10 while the eccentric cam 4 engages the tip of the leg 6*a* of the place shift-up lever 6 with its cam surface. After ten seconds the place shift-up lever 6 starts elevating the forked leg plate side with the stationary shaft 8 as its center (FIG. 2*b*). As the shaft 2 continues to rotate, the operation pin 3 engages and starts to push on the return pawl 11 of the leg 6*b* of the forked leg plate whereby the upper leg 6*a* that has been pushed upwardly by the eccentric cam 4 is elevated to a maximum position at the end of twenty seconds by the cam surface (FIG. 2*c*).

Next the return pawl 11 is pushed toward the right by the operation pin 3 as the shaft 2 continues to rotate and at the end of thirty seconds the place shift-up lever 6 moves toward the right whereupon the upper leg *6a* passes the maximum radius of the eccentric cam 4 and starts to lower (FIG. *2d*). From this condition the operation pin 3 further pushes the return pawl 11 toward the right. At the end of forty seconds when the stationary shaft 8 touches the rear end of the elongated hole 7 and the place shift up lever 6 attains a maximum rightward position, the operation pin 3 passes by the return pawl 11 whereby the maximum radius section of the eccentric cam 4 opposes the lower leg *6b* of the forked leg plate to cause it to further descend (FIG. *2e*).

The operation pin 3 further rotates and at the end of fifty seconds it engages and pushes the hook pawl 10 of the upper leg *6a* so as to start moving the place shift-up lever 6 toward the left. Moreover, the eccentric cam 4 causes the leg *6b* to descend to a lowermost position. At this instant the feed pawl 9 of the upper leg *6a* is positioned on the right side of a tooth of the ratchet wheel 5 (FIG. *2f*). During the passage of time from fifty seconds to one minute, the operation pin 3 presses the hook pawl 10 and causes the place shift-up lever 6 to move toward the left so that the feed pawl 9 turns the ratchet wheel 5 counterclockwise by one tooth thereby shifting up the place and resuming the shift-up start position shown in *2a*.

Figure 3:
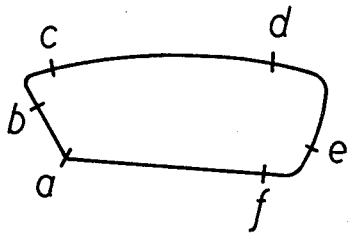
FIG. 3 is a curve showing the orbit of the feed pawl.

The operation of the ratchet feed mechanism may thus be summarized as follows. As the composite action of the vertical rocking motion of the place shift-up lever 6 due to the rotation of the eccentric cam 4 and the sliding motion to the right and left due to the operation pin 3 is imparted to the feed pawl 9, it causes the feed pawl to move in an orbit as illustrated in FIG. 3. The points a–f of the orbit shown in FIG. 3 correspond respectively to the positions shown in FIGS. *2a–2f*. On this orbit of the feed pawl 9 it is caused to move in an outer range where it does not engage with the teeth of the ratchet wheel and is first allowed to engage therewith in the linear portion of the orbit during passage of time from fifty seconds to one minute thereby shifting the ratchet wheel by one tooth.

Figure 4:
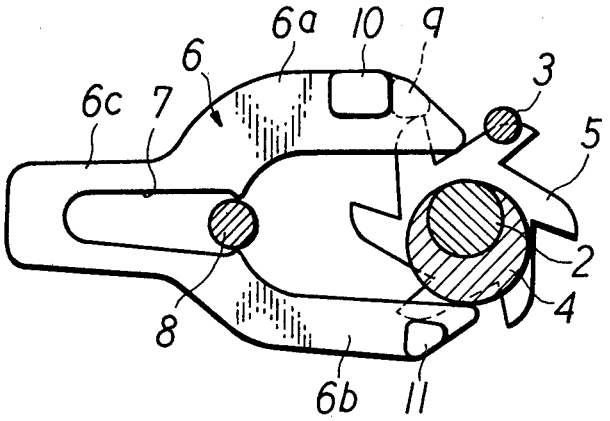
FIG. 4 is a schematic view showing the mode of operation of time correction during the shift-up operation.

In the normal shift-up operation described above, it is possible in accordance with the present invention to effect a time correction of the minute display during the place shift-up operation. Since the ratchet 5 is released from the feed pawl 9 without engaging with it at any time during the sequences shown in FIGS. *2a* through *2e*, a time correction can optionally be made by manually turning the ratchet 5 either in the normal direction or in the reverse direction. When the ratchet wheel 5 is engaged with the feed pawl 9 as shown in FIG. *2f*, it is possible only to correct the minute display in the normal direction. Namely, in the condition where the feed pawl 9 engages with the ratchet wheel 5, as shown in FIG. *2f*, the ratchet wheel 5 can be manually turned in the normal direction (i.e. counterclockwise) whereupon the teeth of the ratchet wheel cause the place shift-up lever to move to the left. Consequently, when the stationary shaft 8 touches the right end of the elongated hole 7 so that the place shift-up lever does not move any further, the feed pawl 9 is pushed upwardly and overrides the teeth of the ratchet wheel thereby allowing the ratchet wheel to rotate in its normal direction as illustrated in FIG. 4.

Figure 5:
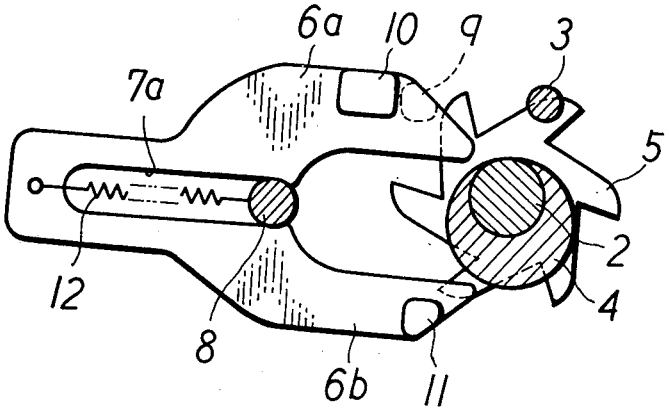
FIG. 5 is a schematic cross sectional view showing the mode of operation of another embodiment of the invention.

FIG. 5 illustrates another method of making the time corection. As is herein shown, the elongated hole *7a* of the place shift-up lever 6 has a length greater than the length required for normal operation and a tension spring 12 is interposed between the left end portion of the place shift-up lever and the stationary shaft 8 so as to urge the lever to return to the original position. This spring 12 has such strength that during normal operation there is a certain play between the shaft 8 and the right end of the elongated hole *7a*. When the ratchet is fed in the normal direction during the place shift-up operation, this arrangement causes the spring 12 to extend so that the teeth of the ratchet push back the feed pawl 9 and move the place shift-up lever further backward. Consequently, the ratchet 5 can pass the feed pawl 9 smoothly without hindrance thereby enabling the time correction.

In this instance since the place shift-up lever 6 is placed at a position slightly backward in comparison with the normal operation condition, it is necessary for the lever to return by means of the force of the spring 12 in a distance corresponding to this retreated distance as soon as it passes by the feed pawl 9 and to prepare for a subsequent place shift-up operation. Means for returning the place shift-up lever are not necessarily restricted to a spring. For example the weight of the place shift-up lever itself may be used for that purpose.

As described above, the ratchet feed mechanism in accordance with the present invention is easy to assembly and makes it possible to accomplish the shift-up operation of the ratchet tooth by tooth in a stable manner by the combination of the rocking motion in the vertical direction of the place shift-up lever due to the eccentric cam and its sliding motion to the right and left due to the operation pin. It is also possible in the ratchet feed mechanism of the present invention to make the time correction in the normal direction even during the shift-up operation. The ratchet feed mechanism of the invention is perfectly free from the problem of a "dead-point" arising from the postures between the ratched and feed pawl of the place shift-up lever actuating the ratchet.

In comparison with the conventional ratchet feed mechanism, the mechanism of this invention has an extremely simplified construction and provides remarkably novel advantages.

What is claimed is:

1. A ratchet feed mechanism comprising:

a rotary shaft, a ratchet wheel rotatably supported by said rotary shaft, a rotary member fixed on said rotary shaft and spaced axially from said ratchet wheel, an operation pin fixed on said rotary member eccentrically on said rotary shaft so as to orbit about the axis of said rotary shaft, said pin projecting axially of said rotary shaft from a side of said rotary member facing said ratchet wheel, an eccentric cam fixed on said rotary shaft between said rotary member and said ratchet wheel, and a place shift-up lever supported so as to be capable of rocking and sliding movement in a plane perpendicular to said rotary shaft and having a forked leg plate with spaced legs receiving said eccentric cam between them, one leg of said forked leg plate having on a first face a hook pawl engageable by said shift-up lever in a feed direction and on a second face a feed pawl engageable with said ratchet wheel to rack said ratchet wheel during movement of said place shift-up lever in said feed direction, and the other leg of said forked plate having on said first face a return pawl engageable by said operation pin to move said place shift-up lever in a return direction, said legs of said forked leg plate being engageable by said cam for rocking said place shift-up lever to bring said hook pawl and return pawl alternately into engagement with said operation pin and for bringing said feed pawl into engagement with said ratchet wheel during movement of said place shift-up lever in said feed direction.

2. A ratchet feed mechanism according to claim 1, in which said place shift-up lever has an elongated hole therein, and in which a stationary shaft received in said elongated hole supports and guides said place shift-up lever for said rocking and sliding movement.

3. A ratchet feed mechanism according to claim 2, in which said elongated hole in said place shift-up lever is a continuation of the space between said legs and is separated therefrom by a restricted portion of slightly less width than the diameter of said stationary shaft, said forked leg plate being resilient to permit said stationary shaft to pass through said restricted portion in assembling the mechanism.

4. A ratchet feed mechanism according to claim 2, in which said elongated hole has a length greater than the movement of said place shift-up lever relative to said stationary shaft and in which means is provided for biasing said place shift-up lever in a direction away from said rotary shaft.

5. A ratchet feed mechanism according to claim 4, in which said biasing means comprises a spring acting between said place shift-up lever and said stationary shaft.

6. A ratchet feed mechanism according to claim 1, in which said cam is engageable with said forked leg plate to lift said feed pawl out of engagement with said ratchet wheel at one phase of rotation of said rotary shaft so as to permit manual rotation of said ratchet wheel in both directions.

7. A ratchet feed mechanism according to claim 1, in which said ratchet wheel has teeth with rearwardly sloping rear faces permitting teeth of said ratchet wheel to override said feed pawl upon manual rotation of said ratchet wheel in a forward direction in one phase of rotation of said rotary shaft.

* * * * *